US005961207A

United States Patent [19]

Petkovic

[11] Patent Number: 5,961,207

[45] Date of Patent: Oct. 5, 1999

[54] TROUBLE LIGHT APPARATUS

[76] Inventor: Peter M. Petkovic, 6360 N. Paulina St., Chicago, Ill. 60660

[21] Appl. No.: 08/876,854

[22] Filed: Jun. 16, 1997

[51] Int. Cl.[6] ..... H01R 33/02

[52] U.S. Cl. ..... 362/376; 362/542; 439/502; 439/236

[58] Field of Search ..... 362/185, 376, 362/377, 378, 487, 542; 439/502, 236

[56] References Cited

U.S. PATENT DOCUMENTS

| | | | |
|---|---|---|---|
| 2,812,423 | 11/1957 | Penna . | |
| 3,761,862 | 9/1973 | Spiteri . | |
| 4,136,381 | 1/1979 | Bone | 362/311 |
| 4,232,357 | 11/1980 | Dietz . | |
| 4,310,874 | 1/1982 | Spiteri . | |
| 4,638,413 | 1/1987 | Tarlow . | |
| 4,999,752 | 3/1991 | Rogers et al. | 362/376 |
| 5,135,407 | 8/1992 | Berends | 439/236 |
| 5,416,685 | 5/1995 | Myers | 362/398 |
| 5,462,452 | 10/1995 | Devine . | |

*Primary Examiner*—Thomas M. Sember
*Attorney, Agent, or Firm*—Richard G. Kinney

[57] ABSTRACT

A trouble light apparatus including a cage in which low voltage (e.g. 12 volt) light(s) are housed, a handle connected to the cage which manual switches are mounted and in which a transformer is secured is disclosed. The handle has a primary cord running from it to a plug that may be fitted into a mating plug. Additionally, a number of secondary cord and mating plugs are provided, one of which can be received in a 12-volt dc cigarette lighter socket, another of which can be received into the conventional ac power (e.g. 120/240 volt ac) receptacle and another of which may have alligator clips for attachment to a battery (e.g. 12 volt automobile battery). The secondary cords contain two electrical lines and the primary cord has three lines. The plugs allow connection to two of the three lines with different pairs of lines connected for the high voltage ac source and the low voltage source. The primary cord pairs from the high voltage ac source and is coupled to the input of the transformer and whose output is connected to the lamp sockets when the switches are operated to select that arrangement. The primary cord pairs from the low voltage source and is connected to the lamp sockets when the switches are operated to select that arrangement. Thus, the trouble light may be powered from either low voltage ac or dc or higher voltage ac by selecting and attaching the correct secondary cord unit to such a source and to the plug of the primary cord and operating the switches on the handle. Two embodiments are disclosed, one for a large 12 volt screw-socket lamp, and a second using a plurality of automobile bayonet base lamps connected either in series or in parallel by manual switches.

18 Claims, 2 Drawing Sheets

TROUBLE LIGHT APPARATUS

FIELD OF THE INVENTION

The present invention is directed to an improvement in a trouble light apparatus and is especially concerned with such apparatus that employs a low voltage lamp.

BACKGROUND OF THE INVENTION

Trouble light apparatus are conventionally made with a cage surrounding a lamp secured in a socket with a handle attached having a switch for controlling the applications of power to the socket and thus, the lamp. A conventional cord connects the handle to a plug that is received in a conventional alternating current (ac) (e.g. 120/240 v) receptacle.

It is also known, as shown in U.S. Pat. No. 2,812,423 issued to J. Penna, to employ a 12 volt lamp in a trouble lamp and connect that lamp to a source of 12 v direct current (dc) derived from an automobile's battery. Dual voltage trouble lamp apparatus' are shown in U.S. Pat. Nos. 3,761,862 and 4,310,874, both issued to J. Spiteri. These dual voltage apparatus' operate from either the conventional ac source (120 v ac) or from a low voltage source (e.g. 12 v dc automobile battery), but they require a special dual filament lamp and socket.

It is also known, in another type of light apparatus, to employ a low voltage lamp and alternative power connections. U.S. Pat. No. 4,232,357 to M. S. Dretz. This arrangement is not as "handy" as the conventional trouble lamps.

It is also known to run two lamps (120 v ac and 12 v dc) from a unit attached to a convertible table lamp socket. U.S. Pat. No. 4,638,413.

Despite these approaches, there still exists a need for a dual voltage trouble lamp that employs lower cost, single filament, low voltage lamps and is convenient to change-over from one source to the other.

SUMMARY OF THE INVENTION

A trouble light apparatus which may be powered from either a conventionally high voltage alternating current electric mains source (e.g. 120/240 v ac) or a low voltage source (e.g. 12 v dc), constructed in accordance with the principles of the present invention has a lamp housing having a handle connected to a low voltage lamp. A transformer, or equivalent means, mounted in the handle is provided which functions to step-down high voltage alternating current. A primary cord connects to the housing and has three electrical conductors with one end of the cord connected to the handle and a male plug at the other end. A second cord having two lines and means and a mains plug at one end and a female plug at its other end is provided. The female plug may mate with the male plug to couple electric power from said mains across two of the three lines. A third cord having two lines and means (such as a cigarette lighter plug or alligator clips) at one end for connection to a low voltage source and having a female plug at its other end. This female plug may mate with the male plug to couple low voltage electric power lines of said primary cord. And the apparatus further includes switch means for alternately coupling the output of said transformer, or other step-down means, to the lamp socket to power the lamp.

A second feature of the invention is the use of a plurality of inexpensive conventional automobile lamps in the cage of a trouble lamp.

DETAILED DESCRIPTION OF THE PREFERRED EMBODIMENTS

Figure 1:
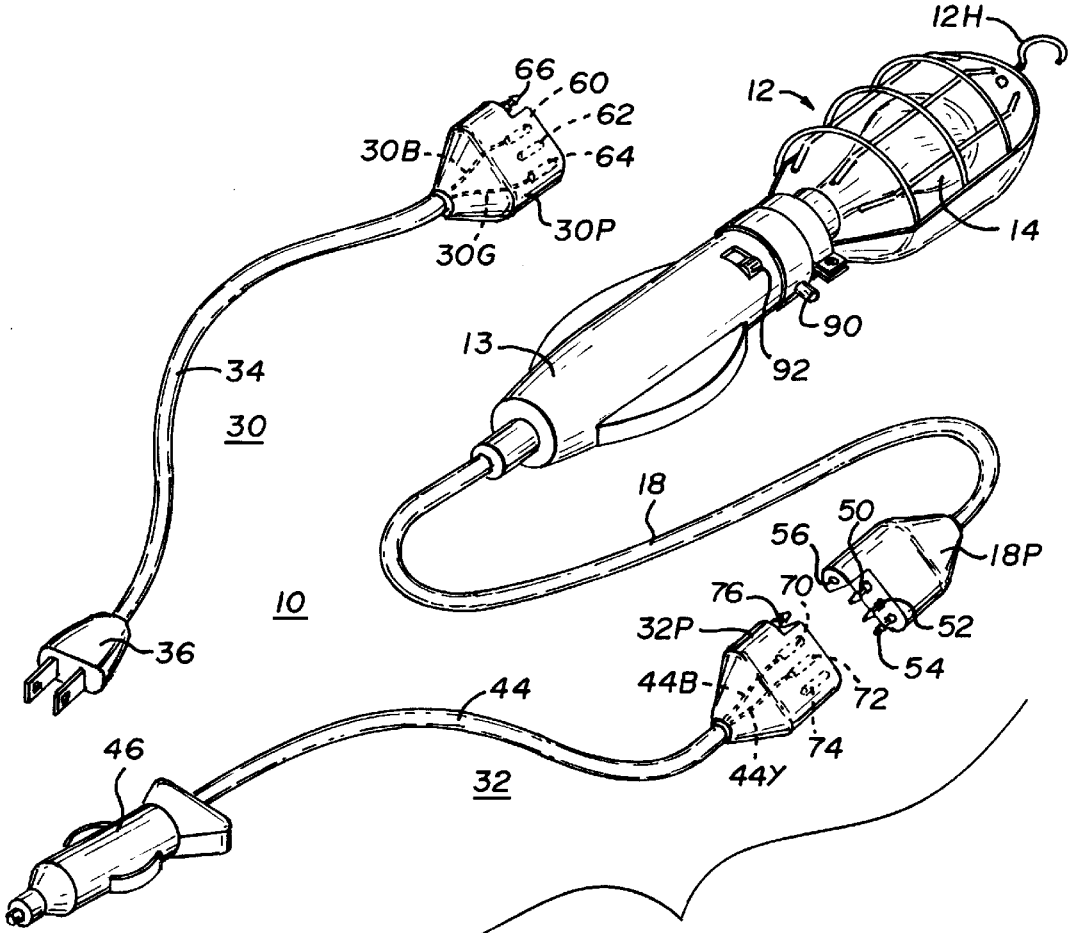
FIG. 1 is a plan view of a trouble light apparatus constructed in accordance with the principles of the present invention.

Referring to FIG. 1, there is depicted a trouble light apparatus 10 having a cage 12 mounted at one end of a handle 13. A lamp 14 of the type having a screw base is housed within the cage 12 and received in a screw socket 16 in the handle 13. A primary cord 18 runs from the opposite end (from the socket 16) of the handle 13. The trouble light apparatus 10 includes conventional features such as a reflector 12R and end hook 12H. However, the lamp 14 is a low voltage lamp (e.g. No. 803862, made by Philips) and the handle has a pair of switches 90 and 92 and incorporates a transformer 100 within it. Further, the cord 18 is a three conductor cord ending in a special male plug 18P. The male plug 18P mates with a female plug such as the plugs 30P or 32P of two separate connection cord units 30, 32. The cord unit 30 has a two conductor cord 34, one end of which is connected to the plug 30P and the other end of which is converted to a standard ac (e.g. 120/240 v) plug 36 which may be connected into a conventional wall socket or similar source of conventional ac power.

The unit 32 also has a two conductor cord 44, one end of which is connected to the plug 32P and the other end of which is connected to a cigarette lighter-type plug 46 which can be plugged into a low voltage source (e.g. 12 v) such as is commonly found on most commercial automobiles.

In more detail, the plug 18P has three male pin terminals 50, 52 and 54 and one female pin receptacle 56. The pins 50, 52 and 54 are connected to the ends of one of the three conductor lines of the cord 18. These lines are indicated in FIG. 1 as 18B, 18G and 18Y and are insulated from one another (as are the pins 50, 52 and 54). The female terminal 56 is not electrically connected to anything, but instead serves to index the plug 18P into the female plug 30P or 32P. (Alternatively, an additional "ground" line can be provided in all cords and pin 56 used to connect this extra ground line. Providing of a "ground" line is conventional, and therefore it is being omitted here.) That is, these plugs can only mate in one way so as to insure that the pins 50, 52 and 54 are connected in only one way to female receptacles in the plug 30P or 32P.

The plug 30P of the cord unit 30 has three female receptacles 60, 62 and 64 and a male pin 66. These mate respectively with pins 50, 52, 54 and receptacle 56. The cord 34 has two conductors 30B and 30G which are insulated from one another and attached at one end to the blades of the ac plug 36 and at the other ends to receptacle 60 and 64.

The plug 32P of the cord unit 32 similarly has three female receptacles 70, 72 and 74 and a male pin 76. The cord 44 contains two conductors 44B and 44Y which are insulated from one another and connected at one end respectfully to receptacles 70 and 74 of the plug 32P and at their other end to the cigarette lighter plug 46.

The cords 34 and 44 are preferably of a 2 or 4 foot length and the cord 18 is preferably a long length, (e.g. 20, 30 or 50 feet).

The trouble lamp apparatus is controlled by the plugging-in of one or the other of the plugs 30P or 32P into the plug 18P and by means of a switch means on the handle 13. The switch means is preferably a toggle slide switch 90 for controlling the lamp 14 "off" or "on" and a selector switch 92 for selecting high voltage ac or low voltage operation.

Figure 2:
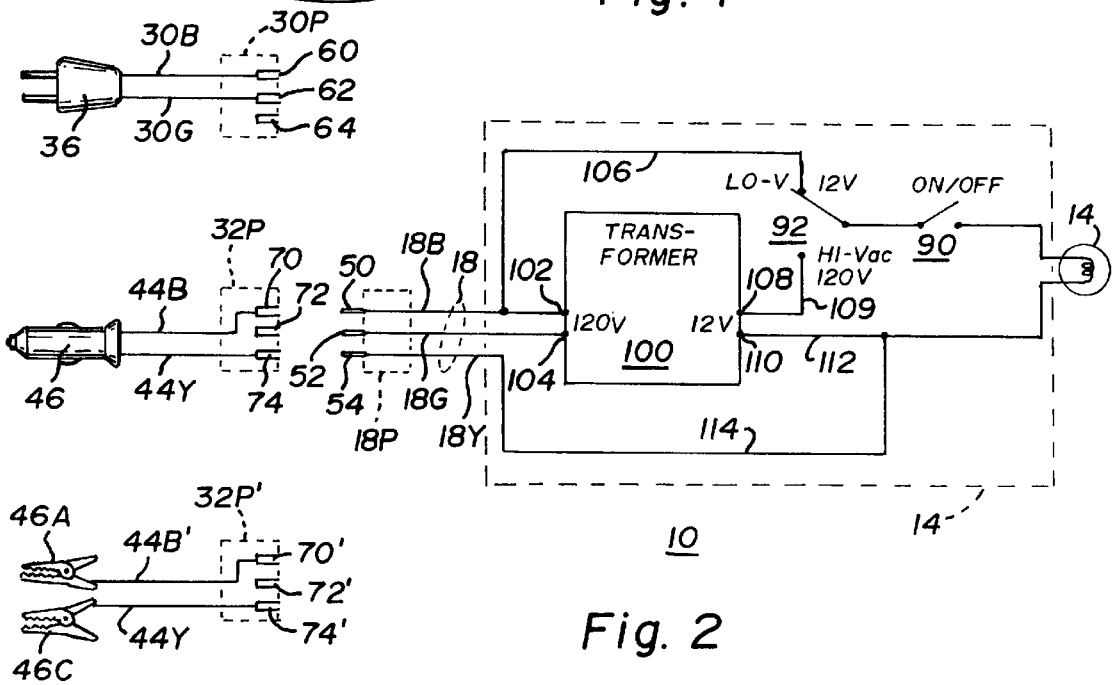
FIG. 2 is an electrical circuit diagram for the apparatus of FIG. 1.

Referring to FIG. 2, the electrical circuit of the trouble light apparatus 10 is there depicted. In addition to the secondary cord units 30 and 32, an alternative unit 32P' employing alligator clips 46A and 46C is depicted as an alternative low voltage source to cigarette plug 46. The wires 18B and 18G of the cord 18 are connected within the handle 14 to the inputs 102, 104 of a transformer 100. The line 18B is also connected over a line 106 to one side of the selector switch 92 whose blade can be connected to that line, or to one of the output 108 of the transformer 100 over a line 109. The blade of switch 92 is connected to one side of the on/off switch 90. The other side of this switch 90 is connected to one side of the lamp 14. The second output terminal 110 of the transformer is connected to the other side of the light 14 via a line 112.

The line 18Y is also connected via a line 114 to the line 112 and one side of the lamp 14.

Operation

Assuming in FIG. 2 that the plug 18P is mated to the plug 30P and the plug 36 is connected to a source of high voltage alternating current, e.g. 120/240 v ac, and the select switch is turned to HI-VAC. The ac source is connected through plug 36 through lines 30B and 30G to receptacle 60 and 62 and through pins 50 and 52 to lines 18B and 18G and then to the inputs 102, 104 of the transformer 100. This is a step-down transformer which produces a lower voltage (e.g. 12 v ac) to the lamp 14 between its outlets 108, 110. This lower voltage (e.g. 12 v ac) is connected via the line 109 through the switch 92 and (if "on") the switch 90 to one side of the lamp 14. The current is completed by the line 112 connection to the output terminal 110 of the transformer 100 to light the lamp.

When it is desired to operate the trouble light apparatus 10 from a low voltage source, the plug 18P is plugged into the plug 32P (or 32P') and dc power is connected via lines 44B and 44Y to receptacles 70, 74 to pins 50 and 54. The low voltage is thus connected over lines 18B and 18Y to the lamp 14 (provided the select switch 92 has its blade connected to line 106 and the switch 90 is "on" or closed) to light that lamp.

Second Embodiment

Figure 3:
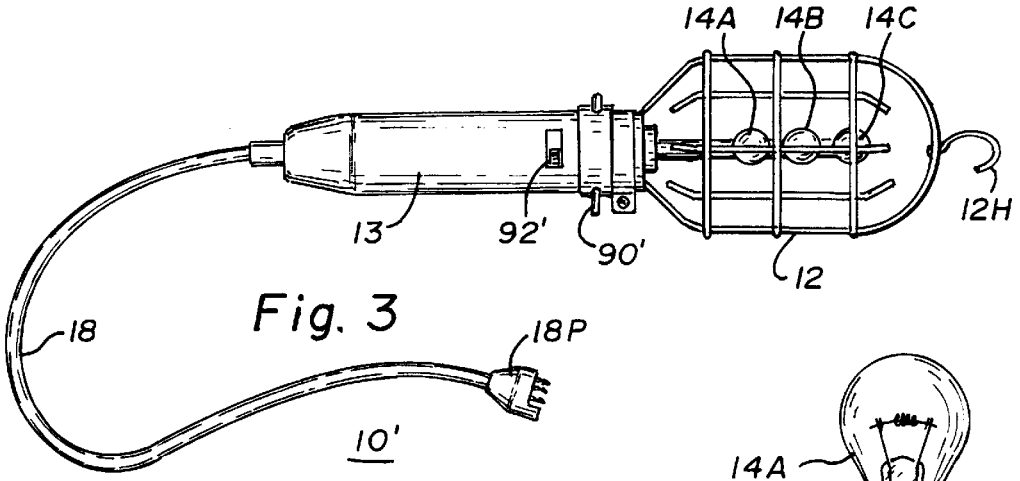
FIG. 3 is an alternative embodiment for a portion of the trouble lamp apparatus of FIG. 1.
Figure 3A:
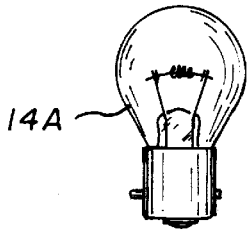
FIG. 3A is a side view of an automobile lamp.

Referring to FIG. 3, there is depicted an alternative construction 10' for the trouble light apparatus 10. In this embodiment, the plug 18P and cord 18 and extension of the handle is essentially the same of the embodiment 10 of FIG. 1 and FIG. 2, but the lamp 14 is replaced by a plurality of 12 v automobile lamps 14A, 14B, and 14C. These are standard lamps such as illustrated in FIG. 3A with a bayonet base. Such lamps are inexpensive and readily available at most automotive shops. This burned-out lamp can be easily replaced from a convenient source.

Although three lamps are illustrated in FIG. 3, four or two or other multiples may be also used.

Figure 4:
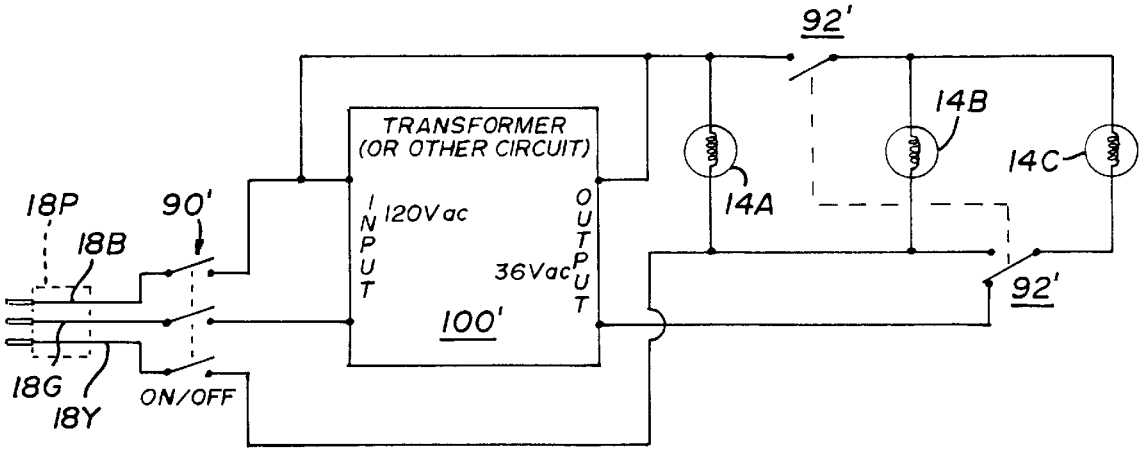
FIG. 4 is a circuit diagram for the alternate trouble light apparatus of FIG. 3.

Referring to FIG. 4, there is depicted a circuit diagram for the trouble light apparatus 10' of FIG. 3. In this case, the transformer 100' has an output of 36 v ac (to power three lamps in series) and the select switch 92' is two ganged together switches which alternate the connection between applying 12 v dc to the lamp 14A, 14B, and 14C in parallel and to applying the output from the transformer to the same three lamps connected in series.

This embodiment of the invention allows for a simpler and less expensive transformer, or other circuit, since it need step-down the source voltage, for example, from 120 v to 36 v instead of 120 v to 12 v.

The "on-off" switch 90' is, in this embodiment, a ganged together three switches which are at the input from the cord 18 so as to open or close all three lines 18B, 18G and 18Y together.

While particular embodiments of the invention have been shown and described, it will be obvious to those in the art that changes and modifications may be made without departing from the invention and, therefore, the aim in the appended claims is to cover all such changes and modifications as fall within the true spirit and scope of the invention. For example, a fluorescent lamp may be substituted for the depicted incandescent lamps, a ground line may be added in the conventional manner, alternative circuitry may be used for stepping-down the ac voltage other then a wound transformer, and other changes made without departing from at least the broader aspects of the present invention.

I claim:

1. A trouble light apparatus which may be powered from either a conventionally high voltage alternating current electric mains source (e.g. 120/240 v ac) or a low voltage source (e.g. 12 v dc), comprising:

a lamp housing having a cage and a handle connected to said cage and a lamp socket means mounted inside said cage;

a low voltage lamp in said socket means;

transformer means having a pair of input terminals and a pair of output terminals, said transformer means functioning to step-down alternating current of the type provided by the electric mains source to a low voltage capable of powering said lamp, said transformer means being mounted in said handle of said housing;

a first power cord connected to said housing and having a first, second and third electrical conductor lines, each of which lines is insulated from the others and each of which lines run through said cord, said cord having one end at said housing and extending a distance therefrom to a free end of said cord;

a plug at the free end of said first power cord having three contact terminals, one connected to each of said first, second and third lines but insulated from one another;

a second power cord housing two electrical conductor lines and means at one end for connection to a mains source and having a mating plug at its other end, which mating plug may mate with said plug of said first cord to couple electric power from said mains source across said first and second lines of said first cord but does not connect power to said third line of said first cord;

a third power cord housing two electrical conductor lines and means at one end of said third power cord for connection to a low voltage direct current source and having a third plug at the other end of said third power cord, which third plug may mate with said plug of said first cord to couple electric power from the low voltage direct current source across said first and third lines of said first cord but does not connect power to said second line of said first cord; and switch means at said housings for alternating coupling the output of said transformer means to said lamp socket to power said lamp therein or to alternatively connect the first and third lines to said socket to power said lamp.

2. The trouble light apparatus of claim 1 wherein a plurality of low voltage lamps are provided in said socket means and said lamps are alternately switched between parallel connection, when connected to the low voltage source, and series connection when connected to said transformer.

3. The trouble light apparatus of claim 2 wherein said plurality of low voltage lamps are each automobile lamps.

4. The trouble light apparatus of claim 1 wherein said socket means receives a screw socket lamp and said lamp is a mating screw socket.

5. The trouble light apparatus of claim 1 wherein said means for connecting to a mains source of said second plug is a conventional bladed plug; and said means for connection to a low voltage direct current source of said third power cord is a cigarette lighter plug.

6. The trouble light apparatus of claim 5 in which said apparatus includes a forth power cord housing two electrical conductor lines, each connected at one end to an alligator clip for allowing connection of the two lines to alternate terminals of a battery, and a fourth plug at said fourth cord's other end for mating with said plug at the free end of said first power cord to couple electric power from said alligator clip across said first and third lines of said first power cord.

7. The trouble light apparatus of claim 6 wherein a plurality of low voltage lamps are provided in said socket means and said lamps are alternately switched between parallel connection when connected to the low voltage source and series connection when connected to said transformer.

8. The trouble light apparatus of claim 7 wherein said plurality of low voltage lamps are each automobile lamps.

9. The trouble light apparatus of claim 1 wherein said means for connecting to a mains source of said second plug is a conventional bladed plug; and said means for connection to a low voltage direct current source of said third power cord is a pair of alligator clips for allowing connection to the terminals of a battery.

10. A trouble light apparatus which may be powered from either a conventionally high voltage alternating current electric mains source (e.g. 120/240 v ac) or a low voltage source (e.g. 12 v dc), comprising:

a lamp housing having a handle;

a low voltage lamp mounted on said handle in said housing;

means for stepping-down alternating current of the type provided by the electric mains source to a low voltage capable of powering said lamp, said stepping-down means being mounted in said handle of said housing;

a first power cord connected to said housing and having a first, second and third electrical conductor lines, each of which lines is insulated from the others and each of which lines run through said cord, said cord having one end at said housing and extending a distance therefrom to a free end of said cord;

a plug at the free end of said first power cord having three contact terminals, one connected to each of said first, second and third lines but insulated from one another;

a second power cord housing two electrical conductor lines and means at one end for connection to a mains source and having a mating plug at its other end, which mating plug may mate with said plug of said first cord to couple electric power from said mains source across said first and second lines of said first cord;

a third power cord housing two electrical conductor lines and means at one end of said third power cord for connection to a low voltage direct current source and having a third plug at said third power cord's other end, which third plug may mate with said mating plug of said first cord to couple electric power from the low voltage direct current source across said first and third lines of said first power cord; and switch means at said housings for alternating coupling the output of said stepping-down means to said lamp to power said lamp or to alternatively connect the first and third lines to said lamp to power said lamp.

11. The trouble light apparatus of claim 10 wherein a plurality of low voltage lamps are provided in said lamp housing and said lamps are alternately switched between parallel connection, when connected to the low voltage source, and series connection when connected to said transformer.

12. The trouble light apparatus of claim 11 wherein said plurality of low voltage lamps are each automobile lamps.

13. The trouble light apparatus of claim 10 wherein said housing receives a screw socket lamp and said lamp is a mating screw socket.

14. The trouble light apparatus of claim 10 wherein said means for connecting to a mains source of said second plug is a conventional bladed plug; and said means for connection to a low voltage direct current source of said third power cord is a cigarette lighter plug.

15. The trouble light apparatus of claim 14 in which said apparatus includes a forth power cord housing two electrical conductor lines, each connected at one end to an alligator clip for allowing connection of the two lines to alternate terminals of a battery, and a fourth plug at said fourth cord's other end for mating with said plug at the free end of said first power cord to couple electric power from said alligator clip across said first and third lines of said first power cord.

16. The trouble light apparatus of claim 15 wherein a plurality of low voltage lamps are provided in said housing and said lamps are alternately switched between parallel connection when connected to the low voltage source and series connection when connected to said transformer.

17. The trouble light apparatus of claim 16 wherein said plurality of low voltage lamps are each automobile lamps.

18. The trouble light apparatus of claim 10 wherein said means for connecting to a mains source of said second plug is a conventional bladed plug; and said means for connection to a low voltage direct current source of said third power cord is a pair of alligator clips for allowing connection to the terminals of a battery.

* * * * *